United States Patent [19]

Kesselring et al.

[11] 4,354,821

[45] Oct. 19, 1982

[54] MULTIPLE STAGE CATALYTIC COMBUSTION PROCESS AND SYSTEM

[75] Inventors: John P. Kesselring, Mountain View; Wayne V. Krill, Sunnyvale, both of Calif.; G. Blair Martin, Cary, N.C.

[73] Assignee: The United States of America as represented by the United States Environmental Protection Agency, Washington, D.C.

[21] Appl. No.: 153,074

[22] Filed: May 27, 1980

[51] Int. Cl.[3] ..... F23D 3/40

[52] U.S. Cl. ..... 431/7; 422/171

[58] Field of Search ..... 431/7, 328; 422/171, 422/172, 173; 60/299, 300, 301, 302

[56] References Cited

U.S. PATENT DOCUMENTS

| | | | |
|---|---|---|---|
| 4,154,568 | 5/1979 | Kendall et al. | 431/7 |
| 4,218,422 | 8/1980 | Schock et al. | 422/171 |
| 4,230,443 | 10/1980 | Berg et al. | 431/7 |
| 4,321,233 | 3/1982 | Tsuji | 431/7 |

*Primary Examiner*—Daniel J. O'Connor

*Attorney, Agent, or Firm*—Flehr, Hohback, Test, Albritton & Herbert

[57] ABSTRACT

A process and system for combusting a nitrogen-containing fuel to produce low $NO_x$ levels in the exhaust emissions. A stream of the fuel mixed with air is combusted in two or more fuel-rich zones having catalytic beds. The stoichiometry of the mixture in each zone is controlled for the particular catalytic material employed so that a minimum of $NO_x$ precursors is formed upon combustion in the zones. Additional air is injected into the flow to maintain the predetermined stoichiometry in the downstream zones. The beds of the fuel-rich zones can be comprised of different catalytic materials having different theoretical air proportion at which the $NO_x$ precursors are at a minimum. The beds of the fuel-rich zones can also be comprised of the same catalyst material having different minima at which $NO_x$ precursors are formed at different theoretical air proportions. A final zone combusts the exhaust products at a stoichiometry of at least 100% theoretical air to substantially complete combustion of fuel. Means can be provided for extracting heat from the flow between the combustion zones.

9 Claims, 4 Drawing Figures

MULTIPLE STAGE CATALYTIC COMBUSTION PROCESS AND SYSTEM

The invention described herein was made in the course of, or under a contract, with the Environmental Protection Agency.

This invention relates in general to fuel combustion technology, and in particular relates to the combustion of nitrogen-containing fuels such as in fire tube boiler systems and gas turbine applications.

The demonstrated harmful effects of air pollution on health and the environment has emphasized the requirement for controlling nitrogen oxide ($NO_x$) emissions in combustion processes. The largest class of combustion equipment responsible for $NO_x$ emissions is boiler systems which account for over 65% of the fuel combustion systems in the United States. The $NO_x$ emissions from these systems result primarily from chemical conversion of the nitrogen contained in the fuels which are burned (fuel $NO_x$), as contrasted to oxidation of atmospheric nitrogen from the air (thermal $NO_x$).

The control of fuel $NO_x$ requires a different approach than that for thermal $NO_x$. Various combustion research studies have shown that combustion staging is a viable fuel $NO_x$ control technique. Heretofore, combustion staging has provided a fuel-rich primary stage followed by secondary air addition and completion of combustion in a later stage. The concept has been demonstrated with a two-stage catalytic combuster producing conversion levels of fuel nitrogen to $NO_x$ as low as 11%. An example of a system employing the two stage combustion process is contained in the application Ser. No. 15,314, filed Feb. 26, 1979 by Wayne Krill, et al.

It would be desirable to achieve even lower levels of fuel nitrogen conversion to $NO_x$ than are obtained with present combustor technology. The requirement for these low conversion levels is of particular importance in burning high-nitrogen fuels with low $NO_x$ emissions.

Accordingly, it is a general object of the invention to provide a new and process a system for the combustion of nitrogen-containing fuels.

Another object is to provide a process and system for the catalytic combustion of nitrogen-containing fuel with low levels of $NO_x$ emissions.

Another object is to provide a process and system of the type described employing multiple catalytic combustion stages with the stoichiometry controlled in a manner minimizing the formation of $NO_x$ precursors.

The invention in summary includes a process and system in which a nitrogen-containing fuel is directed through a series of combustion zones having beds of catalytic materials. In at least two of the upstream zones air is combined with fuel to form a mixture having a fuel-rich stoichiometry in a predetermined percentage of theoretical air which forms a minimum of $NO_x$ precursors upon combustion in the presence of the catalyst material within the respective zone. The flow is directed in series through the fuel-rich zones and into a final combustion zone. Air is combined with the exhaust products in the final zone to form a mixture having a stoichiometry of at least 100% theoretical air to substantially complete combustion of the fuel.

The foregoing and additional objects and features of the invention will appear from the following description in which the several embodiments have been set forth in detail in conjunction with the accompanying drawings.

Figure 1:
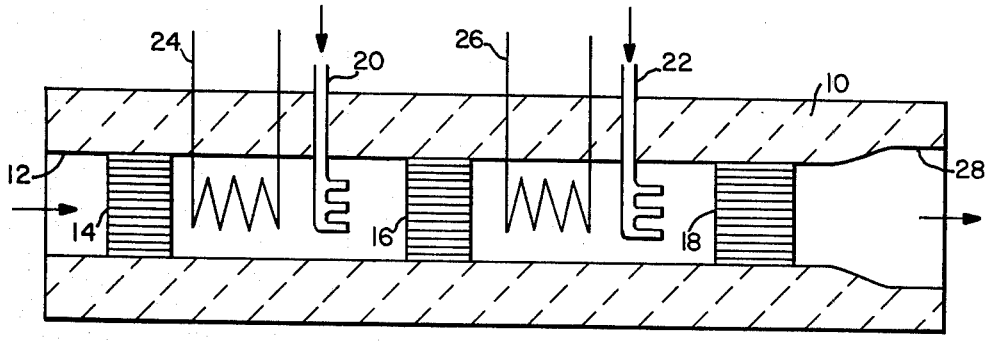
FIG. 1 is a schematic diagram of a multiple stage combustion system incorporating the invention.

The system illustrated in FIG. 1 carries out the process of the invention for combusting nitrogen-containing fuels with high efficiency and relatively low $NO_x$ emissions. The invention has application in a wide field of use including boiler systems and gas turbines.

The non-pollutant nitrogen specie which is desired upon combustion is $N_2$, while the undesirable $NO_x$ pollutants are NO and $NO_2$. Among the potential $NO_x$ precursors upon completion of combustion are $NH_3$, HCN and NO. Certain $NO_x$ precursors are formed during combustion regardless of the structural bonding of the nitrogen contained in the fuel molecule. These precursors can be either oxidized to form $NO_x$ via the reaction:

$$HCN + O_2 \rightarrow NO + CO + H_2O \qquad \text{(Reaction 1)}$$

or reacted with $NO_x$ that has already formed:

$$NO + HCN \rightarrow N_2 + H_2O + CO \qquad \text{(Reaction 2)}$$

$NO_x$ can also be reduced by rich combustion products such as:

$$NO + CO \rightarrow N_2 + CO_2 \qquad \text{(Reaction 3)}$$

$$NO + HC \rightarrow N_2 + H_2O + CO_2 \qquad \text{(Reaction 4)}$$

For eliminating $NO_x$ emissions Reactions 2, 3 and 4 are desired. The multiple stage catalytic combustion system and process of this invention utilizes these reactions in a manner achieving very low emissions as compared to previously known combustion systems, including the prior two-stage catalytic combustors.

The system illustrated in FIG. 1 comprises a high temperature insulated wall 10, shown in axial section, which directs the fuel-air mixture from left to right along a flow channel 12 in series through three or more combustion stages or zones 14, 16 and 18. The initial zone 14 and at least the second combustion zone 16 in the series include beds of catalytic materials selected in accordance with the invention to provide combustion of the mixture which is at a fuel-rich stoichiometry at a predetermined percentage theoretical air. The final combustion zone 18 in the series includes another bed of catalyst material, e.g. Pt or NiO, which completes conversion of the fuel at a stoichiometry of at least 100% theoretical air. For maximum throughput rate, the catalytic beds preferably are of the graded cell configuration of the type disclosed in the U.S. Pat. No. 4,154,568 issued to Kendall, et al.

Air injectors 20, 22 are mounted in the flow channel between the combustion zones for adding air at a controlled rate to establish the fuel/air mixture within the downstream zones at the predetermined stoichiometry.

Heat energy can be extracted from the flow exhausting from the combustors, depending upon the particular application, e.g. in boiler systems. For this purpose, heat exchange coils 24, 26 are mounted in the flow channel for circulating a heat exchange medium such as water. Exhaust from the final combustion zone is directed through outlet 28 to a gas turbine or to a stack for a boiler system, depending upon the particular application.

The catalyst materials forming the beds in the fuel-rich zone are selected so that they produce minimum conversions of fuel nitrogen to $NO_x$ precursors at different values of theoretical air, with the catalyst in the downstream zones having progressively higher minimum points. This important concept of the invention achieves the markedly lower $NO_x$ emissions through multiple combustion staging. In one embodiment of the invention, the catalyst materials of the first and second zone 14, 16 are of different active elements having the different minimum conversion points. As examples, the catalyst materials could comprise $Co_2O_3$ (zone 14) in series with Pt (zone 16), or $Co_2O_3$ (zone 14) in series with NiO (zone 16), or Pt (zone 14) in series with NiO (zone 16). Other catalysts suitable for this purpose are those disclosed in Table C-17 at p. 224, 225 of Chemical and Process Technology Encyclopedia (McGraw-Hill, 1974), as well as the monolithic catalyst structures disclosed in International Patent Application No. PCT/US79/00814 filed Oct. 3, 1979 by Acurex Corporation.

Figure 2:
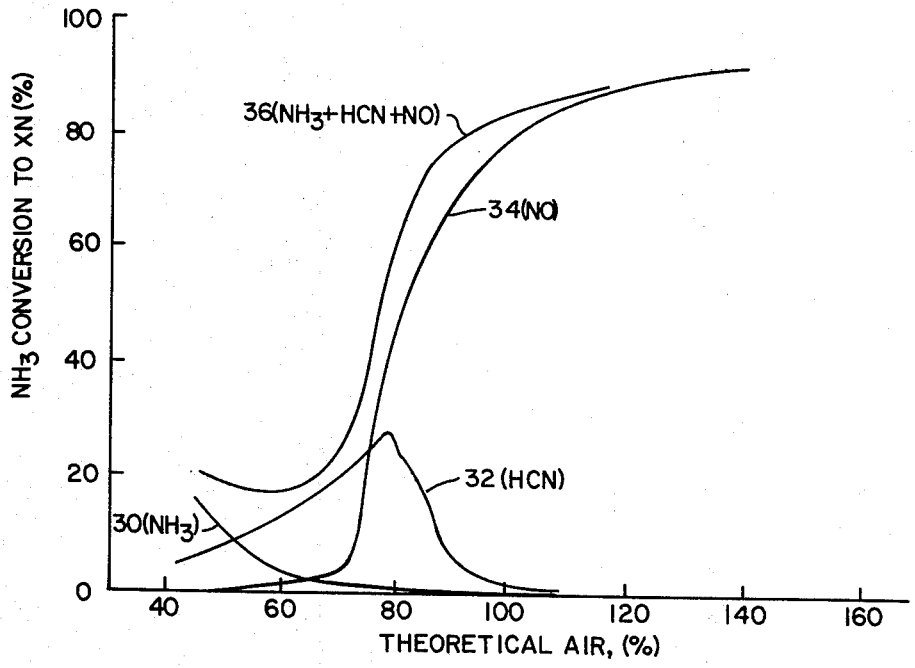
FIG. 2 is a chart depicting the conversion of fuel to $NO_x$ precursors as a function of theoretical air in the first stage combustion zone of the system of FIG. 1.
Figure 3:
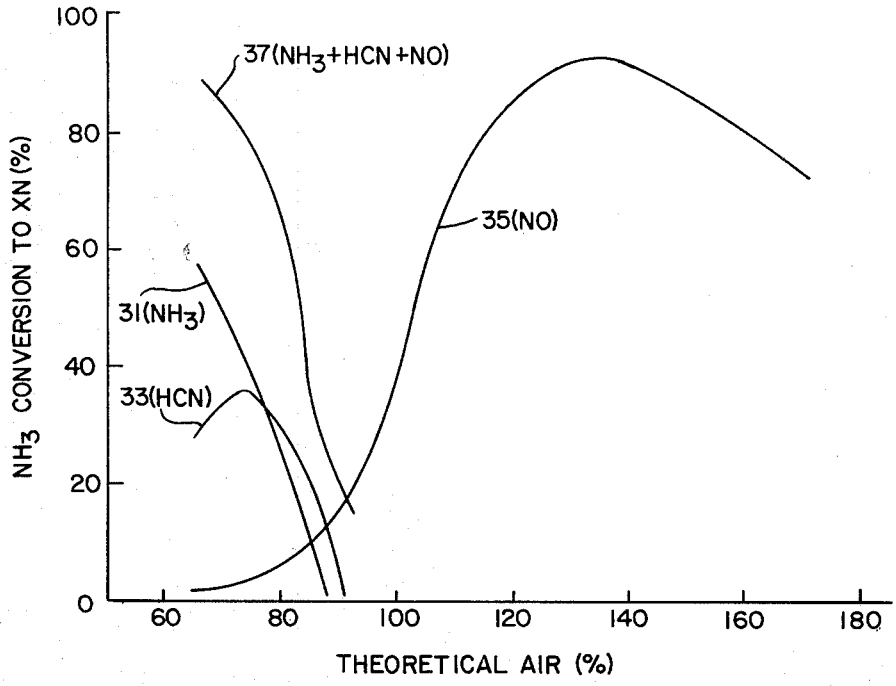
FIG. 3 is a chart depicting the conversion of fuel to $NO_x$ precursors as a function of theoretical air for the second combustion zone of the system of FIG. 1.

The graphs of FIGS. 2 and 3 reflect the operation of the fuel-rich combustion zones for a system of the first embodiment (employing $Co_2O_3$ and Pt catalysts) using natural gas fuel with $NH_3$ added as a fuel nitrogen compound. FIG. 2 depicts the results of combustion for the $Co_2O_3$ catalyst bed in the first zone showing $NH_3$ conversion to the potential $NO_x$ precursors ("XN" on the graphs) as a function of percent theoretical air. FIG. 3 depicts the results of combustion for the Pt catalyst bed of the second zone showing the $NH_3$ conversion to the potential $NO_x$ precursors as a function of percent theoretical air. The $NO_x$ precursors include $NH_3$ shown by curve 30 (FIG. 2) and 31 (FIG. 3), HCN shown by curve 32 (FIG. 2) and 33 (FIG. 3) and NO shown by curve 34 (FIG. 2) and 35 (FIG. 3). The desired non-pollutant nitrogen specie $N_2$ is represented by the curve 36 (FIG. 2) and 37 (FIG. 3) which is the difference between the summation of the conversion curves ($NH_3$+HCN+NO) and 100%.

As shown in FIG. 2 the desired minimum conversion condition in the first combustion zone is achieved at approximately 60% theoretical air where the total conversion of fuel nitrogen to $NO_x$ precursors is approximately 20%. The remaining 80% of the fuel nitrogen is converted to $N_2$.

As shown by the graph of FIG. 3, the minimum conversion in the second combustion zone occurs at a different and higher value of theoretical air, and for the Pt catalyst employed in this case the minimum occurs at 90% theoretical air where the total conversion of fuel nitrogen to $NO_x$ precursors is approximately 20%. In the second stage the remaining 80% of the fuel nitrogen is converted to $N_2$. Secondary air is added to the flow between the two stages by injector 20 to attain the 90% theoretical air stoichiometry for the second zone.

Tertiary air is added by injector 22 to the flow of exhaust from the second zone for combustion in the final zone 18. The tertiary air is added at a rate to establish at least 100% theoretical air in the mixture, and preferably the stoichiometry is on the order of 110% theoretical air. Combustion in the final zone provides burnout to complete conversion of the fuel.

In the system of the first embodiment the overall nitrogen conversion to $NO_x$ in the fuel-rich combustion zones is theoretically calculated as $0.2\times0.2=4.0\%$. Under actual operating conditions, however, the rates of reduction by the reactions of equations 2, 3 and 4 depend on the relative concentrations of the reactant species. Thus, HCN, CO and HC would all be present in lower concentrations in the second stage of the configuration of FIG. 1 as compared to the concentrations following a single stage of combustion. The simple multiplication of the single stage conversion rates does, however, represent a minimum conversion level for overall operation of the multiple stage system.

In another embodiment of the invention, the multiple stage combustor arrangement of FIG. 1 is utilized with both of the fuel-rich combustion zones having beds of the same catalyst material of a selected type having two distinct minima of formation of $NO_x$ precursors. The stoichiometry of the inflowing mixture is controlled so that combustion takes place in the first zone at one minima, and secondary air is thereafter injected to control the stoichiometry of the mixture in the second zone so that combustion takes place at the second higher minima. Catalyst beds of Pt or NiO are examples of active elements each having two different minima and which can be employed in this embodiment.

Figure 4:
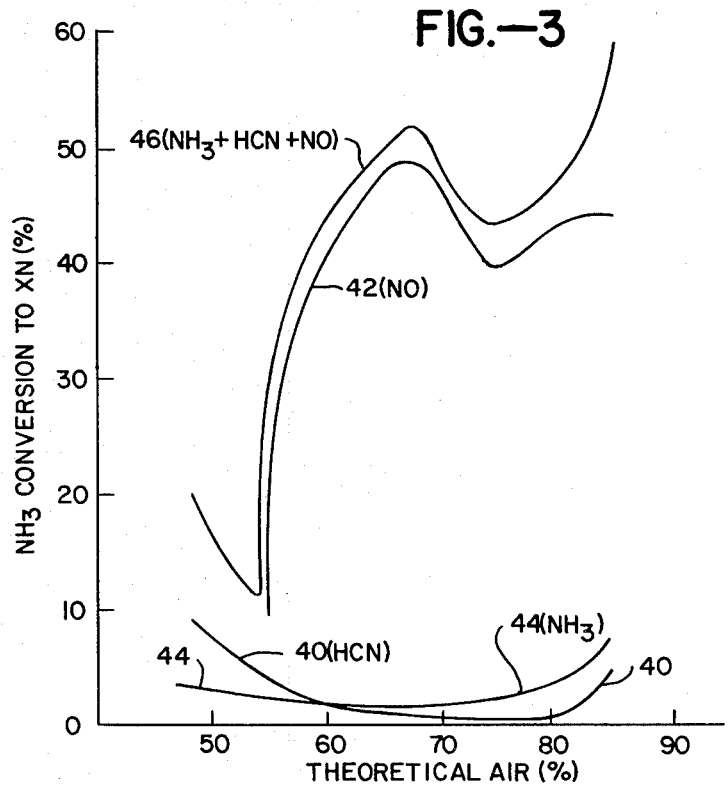
FIG. 4 is a chart depicting the conversion of fuel to $NO_x$ precursors as a function of theoretical air for another embodiment in which two combustion zones employ a catalyst material having different minima of $NO_x$ precursor formation.

The chart of FIG. 4 reflects the operation of a multiple stage combustor of the invention employing Pt as the catalyst for both beds of the fuel-rich combustion zones 14, 16. The combustor was operated using natural gas fuel with $NH_3$ added as a fuel nitrogen compound. The curves depict the conversions to the potential $NO_x$ precursors upon completion of combustion as a function of percent theoretical air. Curve 40 depicts conversion to HCN, curve 42 depicts the conversion to NO and curve 44 depicts the conversion to $NH_3$. The desired non-pollutant nitrogen specie $N_2$ is represented by the curve 46 which is the difference between the summation conversion curves ($NH_3$+HCN+NO) and 100%. The curve 46 shows two distinct minima occurring at 55% theoretical air and 75% theoretical air. In operation the incoming fuel-air mixture to the first stage is therefore controlled at 55% theoretical air to produce approximately 11% conversion to $NO_x$ precursors. Secondary air is added to the exhaust from the first stage by injector 20 to achieve 75% theoretical air for combustion in the second stage. In the second stage, there is approximately 42% conversion to $NO_x$ precursors so that multiplication of the conversion rates shows a theoretical overall minimum conversion level of 4.5%. Tertiary air is added by injector 22 for burnout combustion in the final zone to complete conversion of the fuel.

While the foregoing embodiments provide two fuel-rich combustion stages in series with a burnout stage, the invention also comtemplates the use of three or more fuel-rich stages in the series to provide for a greater reduction of $NO_x$ emissions.

EXAMPLE I

A three stage combustor system according to the schematic of FIG. 1 includes graded cell catalyst beds in each of the combustion zones. Each of the three beds has a length of three inches and a diameter of 3.6 inches. The beds are formed with a plurality of cells of hexagonal cross-sectional shape, with the first zone cells of ¼" mean diameter, the second zone cells of 3/16" mean diameter and the final zone of ⅛" mean diameter. The catalyst material for the bed in the first zone comprises $Co_2O_3$ and the catalyst material for the beds of the second and final zone comprises Pt. The system is operated on a fuel comprising natural gas to which ammonia is added in the amount of between 0.1 and 2.0% of the fuel. The fuel is mixed with air to provide a stoichiometry of 60% theoretical air and the flow rate into the first zone is 12 SCF/min. The mixture is combusted in the first zone in the range of 2300°-2400° F. resulting in 20% conversion to $NO_x$ precursors. Secondary air is injected into the exhaust from the first zone to form a fuel-rich air mixture in the second zone at a stoichiometry of 90% theoretical air. The mixture is combusted in the second zone in the range of 2200°-2500° F. (which is varied with the rate of heat extraction by the coil 24) resulting in 20% $NH_3$ conversion to $NO_x$ precursors. Tertiary air is injected into the exhaust from the second zone to form a fuel/air mixture in the final zone at a stoichiometry of 110% theoretical air. This mixture is combusted in the final zone in the range of 2200°-2500° F. (which is varied with the rate of heat extraction by coil 26) to complete burnout of the fuel. The overall minimum conversion level of fuel nitrogen to $NO_x$ is 4.0%.

EXAMPLE II

A multiple stage combustor system as described for Example I employs Pt as the catalyst material in the beds of both fuel-rich combustion zones as well as the final zone. Natural gas with ammonia added as described in Example I is mixed with air at a stoichiometry of 55% theoretical air and flows through the first zone at 12 SCF/min. for combustion at 11% conversion to $NO_x$ precursors. Secondary air is injected into the exhaust from the first zone to provide a mixture in the second zone at a stoichiometry of 75% theoretical air. Combustion in the second zone results in a 41% conversion to $NO_x$ precursor. Tertiary air is injected into the exhaust from the second zone to provide a mixture in the final zone at 110% theoretical air for burnout. The overall minimum conversion level of fuel nitrogen to $NO_x$ is 4.5%.

EXAMPLE III

A multiple stage combustor as described for Example I incorporates NiO as the catalyst material for both fuel-rich combustion zones as well as the final zone. Natural gas with ammonia added as in Example I is mixed with air at a stoichiometry of 70% theoretical air flowing at 12 SCF/min. for combustion in the first zone with a resulting 50% conversion to $NO_x$ precursors. Secondary air is then injected to provide a mixture in the second zone at a stoichiometry of 90% theoretical air, with a resulting 20% conversion to $NO_x$ precursors. Tertiary air is then injected to provide a mixture in the final zone at a stoichiometry of 110% theoretical air for burnout. The overall minimum conversion of fuel nitrogen to $NO_x$ is 10.0%.

EXAMPLE IV

A multiple stage combustor as in Example I incorporates $Co_2O_3$ as a catalyst material for the bed in the first zone, NiO as the catalyst material for the bed in the second zone and Pt as the catalyst for the bed in the final zone. Natural gas with ammonia added as in Example I is mixed with air to provide a mixture following at 12 SCF/min. into the first zone at a stoichiometry of 60% theoretical air. Combustion in the first zone results in 2.0% conversion to $NO_x$ precursors. Secondary air is added to the exhaust to provide a mixture in the second zone at a stoichiometry of 90% theoretical air, with combustion in this zone resulting in a 2.0% conversion to $NO_x$ precursors. Tertiary air is added to provide a mixture in the final zone at a stoichiometry of 110% theoretical air for burnout. The overall minimum conversion of fuel nitrogen to $NO_x$ is 4.0%.

EXAMPLE V

A multiple stage combustor as in Example I incorporates Pt as the catalyst material for the first fuel-rich zone, NiO as the catalyst material for the second fuel-rich zone, and NiO as the catalyst material for the final zone. Natural gas with ammonia added as in Example I is mixed with air to provide a stoichiometry of 55% theoretical air flowing at a rate of 12 SCF/min. into the first zone. Combustion in the first zone results in 11% conversion to $NO_x$ precursors. Secondary air is added to provide a mixture in the second zone at a stoichiometry of 90% theoretical air, with combustion resulting in 41% conversion to $NO_x$ precursors. Tertiary air is added to provide a mixture in the final zone at a stoichiometry of 110% theoretical air for burnout. The overall minimum conversion of fuel nitrogen to $NO_x$ precursors is 2.0%.

The foregoing demonstrates that the present invention provides significant $NO_x$ emissions control in combustion processes. One embodiment of the invention employing three combustion stages demonstrates a reduction in $NO_x$ production by a factor of two over that of previous two-stage combustors. A conversion of 10% and less of fuel nitrogen to $NO_x$ provides a significant improvement over conventional systems, and has application to gas turbine combustors as well as boiler systems.

While the foregoing embodiments are at present considered to be preferred it is understood that numerous variations and modifications may be made therein by those skilled in the art and it is intended to cover in the appended claims all such variations as and modifications as fall within the true spirit and scope of the invention.

What is claimed is:

1. A process for combusting a nitrogen-containing fuel with high efficiency and low levels of $NO_x$ emissions, comprising the steps of directing a flow of the fuel in series through at least two fuel-rich combustion zones each having a bed of a catalytic material, combining air with the fuel in each zone to form a fuel-rich mixture with the percentage of theoretical air in the mixture being established at the value where a minimum of $NO_x$ precursors is formed upon combustion in the presence of the catalytic material within the respective zone, combusting the mixture in each zone at a temperature $<2600°$ F. to form exhaust products, directing the exhaust products from the last fuel-rich zone in the series into a final combustion zone having a bed of catalytic material, combining air with the exhaust products in the final zone to form a mixture having a stoichiometry of at least 100% of theoretical air, and combusting the mixture in the final zone to substantially complete combustion of the fuel.

2. A process as in claim 1 in which two of the fuel-rich combustion zones have beds of different catalytic material which upon combustion of the mixture in the respective zone forms minimas of $NO_x$ precursors at different percentages of theoretical air in the respective zones.

3. A process as in claim 2 in which the catalytic material of the bed in the fuel-rich zone which is downstream in the series from the first zone causes the combustion to form the minimum of $NO_x$ precursors at a percentage of theoretical air which is greater that the percentage of theoretical air in the mixture which combusts to form the minimum of $NO_x$ precursors in the first fuel-rich zone.

4. A process as in claim 3 in which the catalytic material which forms the bed in the first fuel-rich zone in the series is selected from the group consisting of $Co_2O_3$, NiO and Pt, and the catalyst material which forms the bed in the downstream fuel-rich zone is selected from a group consisting of Pt and NiO.

5. A process as in claim 1 in which the mixture in the final zone is combusted in the presence of a catalyst material at a stoichiometry of at least 100% theoretical air to substantially complete combustion of the fuel.

6. A process as in claim 1 in which the beds in two of the fuel-rich zones are comprised of a catalytic material having separate minima of formation of $NO_x$ precursors at different percentages of theoretical air, and air is combined with the fuel in the second zone in the series to form a percentage of theoretical air corresponding to one of the minima which is greater than the percentage of theoretical air for the other minima for the mixture in the first zone in the series.

7. A process as in claim 6 in which the catalyst material which forms the beds of the fuel-rich zones is selected from the group consisting of Pt and NiO.

8. A process as in claim 1 in which air is injected into the flow between the fuel-rich combustion zones at a rate which is controlled to form the predetermined stoichiometry of the mixture in the zone downstream of the addition of the air.

9. A process as in claims 1 or 8 in which heat is extracted from the flow between at least two of the combustion zones.

* * * * *